US006393666B2

(12) United States Patent
Verzegnassi et al.

(10) Patent No.: US 6,393,666 B2
(45) Date of Patent: May 28, 2002

(54) CONTROL UNIT FOR "PILGRIM STEP" OPERATION OF THE DETACHING CYLINDERS IN A COMBING MACHINE

(76) Inventors: Angelo Verzegnassi, Via Sottomonte 130, Manzano, Udine; Sergio Benetti, Via Aquileia 18/A, Ronchi dei Legionari, Gorizia; Girolamo Prandini; Giovanni Battista Pasini, both of Via S. Alberto 2, Palazzolo Sull'Oglio, Brescia, all of (IT)

( * ) Notice: Subject to any disclaimer, the term of this patent is extended or adjusted under 35 U.S.C. 154(b) by 0 days.

(21) Appl. No.: 09/827,414

(22) Filed: Apr. 6, 2001

(30) Foreign Application Priority Data

Apr. 11, 2000 (IT) ..... MI00A0783

(51) Int. Cl.[7] ..... D01G 19/00

(52) U.S. Cl. ..... 19/115 R; 19/215; 19/223; 19/225

(58) Field of Search ..... 19/115 R, 115 A, 19/215, 216, 217, 223, 224, 225, 229, 230, 231, 232; 74/25, 52

(56) References Cited

U.S. PATENT DOCUMENTS 3,479,699 A * 11/1969 Von Kaenel et al. ..... 19/223
3,960,024 A * 6/1976 Mori et al. ..... 74/52
4,166,399 A * 9/1979 Kiper et al. ..... 19/229
5,014,397 A * 5/1991 Katori et al. ..... 19/231
5,022,122 A * 6/1991 Clement ..... 19/225
5,095,586 A * 3/1992 Wust et al. ..... 19/115 R
5,517,725 A * 5/1996 Mandl et al. ..... 19/225
5,546,636 A * 8/1996 Mandl et al. ..... 19/231

FOREIGN PATENT DOCUMENTS

EP 0 374 723 B1 9/1994
IT 22135A/87 10/1987

* cited by examiner

*Primary Examiner*—John J. Calvert
*Assistant Examiner*—Gary L. Welch
(74) *Attorney, Agent, or Firm*—Hedman & Costigan, P.C.

(57) ABSTRACT

A control unit (10) for "pilgrim step" operation of the detaching cylinders (22, 23) in a combing machine, comprising a first electric motor, which rotates the circular comb (18) of the combing machine with uniform motion and a second electric motor (11), rotating a shaft (12), which houses the components to transmit motion to the detaching cylinders (22, 23). The first electric motor also operates at least one of the components that transmit motion to the detaching cylinders (22, 23), and the motor (11) is operated with a law of motion comprising acceleration and deceleration phases. Both motors mesh at all times and the first motor operates the components to transmit motion to the detaching cylinders (22, 23) by means of a differential device to obtain motion of the "pilgrim step" type.

5 Claims, 4 Drawing Sheets

CONTROL UNIT FOR "PILGRIM STEP" OPERATION OF THE DETACHING CYLINDERS IN A COMBING MACHINE

BACKGROUND OF THE INVENTION

FIELD OF THE INVENTION

The present invention relates to a control unit for "pilgrim step" operation of the detaching cylinders of a combing machine.

As is known, combing machines are used to comb natural textile fibres; this operation consists in positioning the fibres in a parallel direction, to make them suitable for subsequent spinning treatments.

To perform this combing operation of the textile fibres, known combing machines are provided with a plurality of components that act on the textile fibres and operate in synchronism.

BRIEF SUMMARY OF THE INVENTION

In particular, combing is performed by means of a circular comb with a toothed sector to penetrate between the fibre cloth tufts, so that the teeth of the toothed sector remove the short fibres.

Moreover, a group of detaching cylinders moves the combed fibre tuft forwards and backwards, according to a movement commonly known as "pilgrim step", in synchronism with the movement of the circular comb.

Examples of such combing machines are described in the patents No. MI 22135A/87 and No. EP 0 374 723.

In the first of these known systems, a cam, provided with uniform rotary motion, engages with contrast rollers that provide alternate movement to a connecting rod, the latter being joined to an end of a forked arm, mounted on a shaft entering a differential.

Splined on this shaft is a toothed wheel or planetary gear that engages another three input planet wheels, in turn connected to output planet wheels that engage an output planetary gear, flanged on which is a gear.

This gear meshes with a pair of spools, fitted at the ends of respective spindles, provided with a splined portion, and realising the detaching cylinders.

By means of this combination of components, alternate movement of the connecting rod is transmitted to the detaching cylinders to perform "pilgrim step" movement of these.

Nonetheless, in this system, there are components to transmit motion to the detaching cylinders, such as the connecting rod, provided with alternate movement, which must thus be started, stopped and made to start up again in the opposite direction, which is somewhat wasteful from the point of view of energy and also the source of undesired excessive stress on the machine.

A second known system is described in the patent No. EP 0 374 723.

According to this solution, "pilgrim step" movement of the detaching cylinders is obtained using an electric motor, in particular a brushless motor, to operate the detaching cylinders by means of suitable reduction components.

The electric motor is fed with electrical impulses synchronised with the rotary movement of the circular combs; moreover, the electric motor is reversible, so that the detaching cylinders can rotate both forwards and backwards.

Although devices of this second type are able to perform the function for which they have been designed, they have the shortcoming that the motors to operate the detaching cylinders must be stopped and started up again.

Therefore, the object of the present invention is to create a control unit for operation of detaching cylinders in a combing machine that allows the above problems to be solved, permitting efficient operation of the combing machine.

Another object of the present invention is to create a control unit for operation of the detaching cylinders that allows better operating characteristics and greater overall efficiency of the combing machine to be obtained, together with decreased wear through time, owing to reduced stress.

Yet another object of the present invention is to present a control unit for operation of detaching cylinders that can be set at work in a simple and inexpensive manner, without the need to use costly materials or complex technologies.

These and other objects are achieved with a control unit for "pilgrim step" operation of the attaching cylinders in a combining machine, having a control unit (10), for "pilgrim step" operation of a plurality of detaching cylinders (22,23) in a combing machine, comprising a first electric motor (1), which rotates with uniform motion components of the aforesaid combing machine by way of a shaft (17) and a second electric motor (11), which rotates a shaft (12), said shaft (12) housing components to transmit motion to said detaching cylinders (22, 23), said first electric motor (1) also acts on components of a control unit (10) to transmit motion to said detaching cylinders (22, 23), and said second motor (11) is provided with means of operation with a unidirectional law of motion comprising acceleration and deceleration phases, where both said first and second motors are connected by tooth gears (15, 16) at all times and always rotate continuously in one direction and their rotary motions are combined by means of a differential device to obtain resulting motion of the "pilgrim step" type on said detaching cylinders (22, 23).

Further characteristics of the present invention are defined, moreover, in the subsequent claims.

Further objects and advantages of the present invention will emerge more clearly from the description below and appended drawings, provided as a purely exemplary and non-limiting example, in which:

With specific reference to the figures mentioned, all components used for the combing operation are indicated globally with the numeric reference 30, while the control unit for operation of the detaching cylinders, according to the present invention is indicated globally with the numeric reference 10.

As the structure of the combing machine is well-known in the art it is not further described in detail herein; therefore, only the operating components useful for the interpretation and embodiment of the invention are mentioned.

Figure 1:
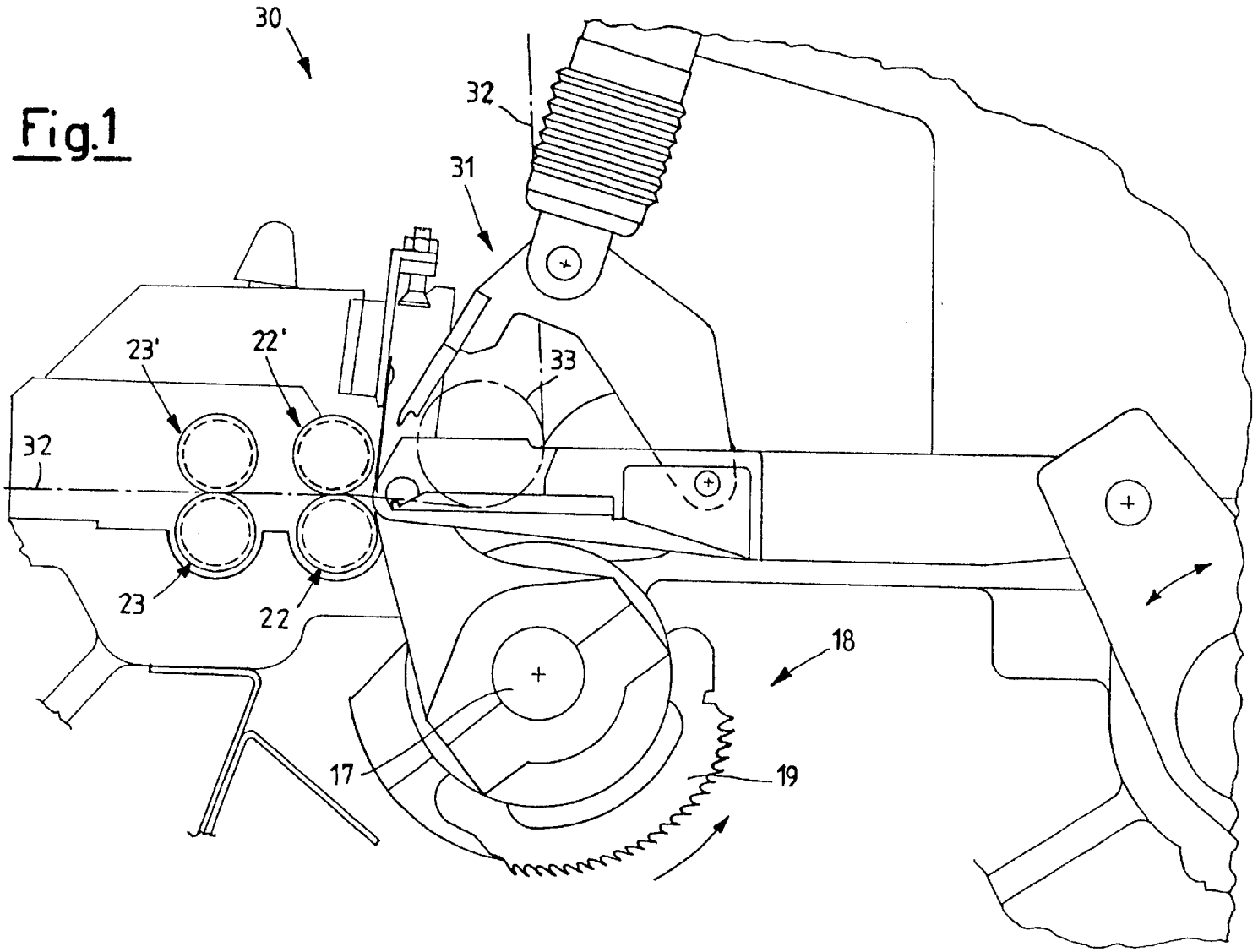
FIG. 1 represents a side elevation of the main components inside the combing machine, which are used to comb the fibres.

FIG. 1 shows the components 30 used for combing operations, in a combing machine.

In this a feed cylinder 33 guides a fibre cloth 32 in the combing zone, formed essentially of a nipper unit 31, collaborating with a circular comb 18, made to rotate by a main motor and equipped with a toothed sector 19, in turn collaborating with a unit of detaching cylinders 22, 23, 22' and 23'.

In particular, combing of the textile fibres is performed by the action of the toothed sector 19 which penetrates between the tufts of the fibre cloth 32, by means of its uniform rotation, while the detaching cylinders 22, 23, 22' and 23' move the fibre cloth 32 forwards and backwards, according to the movement known as "pilgrim step".

DETAILED DESCRIPTION OF THE INVENTION

This description makes it easier to understand the structure and operation of the control unit 10 for operating the detaching cylinders 22 and 23 of the combing machine, according to the present invention.

Figure 2:
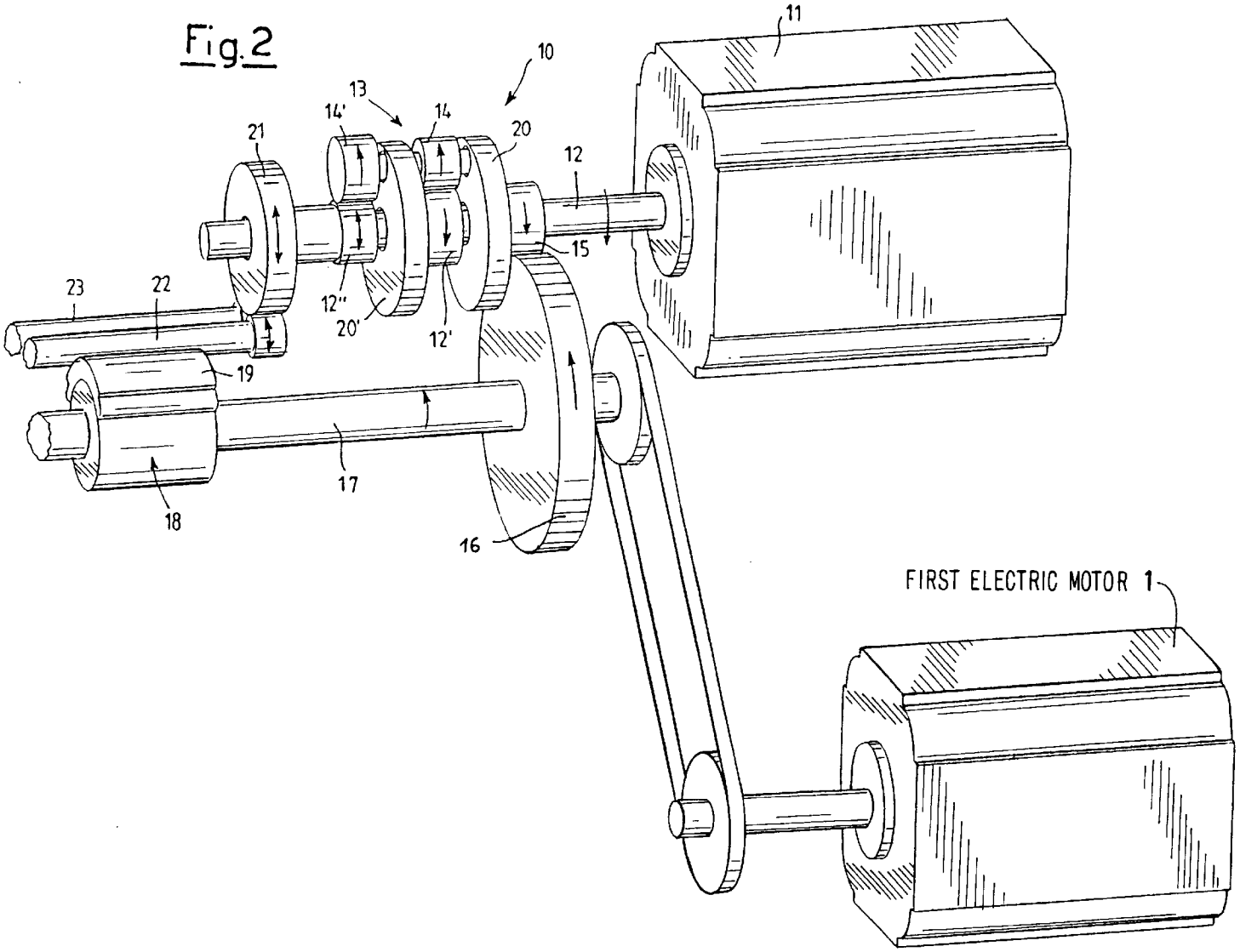
FIG. 2 represents an axonometric projection of the control unit for operation of the detaching cylinders in a combing machine, according to the present invention.

With reference to FIG. 2, the control unit 10 has an electric motor 11 that rotates a shaft 12.

Mounted idle on the shaft 12 is a planetary gear 13, equipped with a planet wheel 14, mounted idle on an input disk 20.

The planetary gear 13 also has a toothed wheel 15 that is engaged by a corresponding toothed wheel 16, operated by the main electric motor of the combing machine (not shown for simplicity).

A shaft 17 is also splined to the toothed wheel 16; this rotates the circular comb 18 of the combing machine, equipped with its toothed sector 19.

The planet wheel 14, mounted on the planetary gear 13 on the input disk 20, is idle and is rotated by rotation of the shaft 12, by engaging with the pinion 12', and is connected, by means of an output disk 20' to another planet wheel 14' that transmits its motion to a transmission component 21, which is idle and connected by its toothed wheel to the detaching cylinders 22 and 23.

The planet wheel 14' transmits its motion to the transmission component 21, by means of the toothed pinion 12".

The shaft 17 is rotated uniformly by the main electric motor, in order to make the circular comb 18 of the combing machine rotate uniformly.

Besides this function, the shaft 17 transmits, by means of the toothed wheel 16, its rotary motion to the toothed wheel 15, connected to the planetary gear 13.

This motion rotates the planetary gear 13 and in particular the input disk 20 and corresponding planet wheel 14.

Simultaneously, the secondary or modulating electric motor 11 rotates the shaft 12, according to a specific law of motion better illustrated below.

Therefore, the planet wheel 14, mounted idle and already rotating in one direction due to the motion imparted by the input disk 20, receives rotary motion in the opposite direction from its mesh with the pinion 12', to function like a differential device.

This complex movement is transmitted, through the output disk 20', to the planet wheel 14', which in turn transmits it to the transmission component 21, from where it is transmitted to the detaching cylinders 22 and 23.

When the fibre cloth 32 moves forwards and backwards, the detaching cylinders 22' and 23', which are idle, move with it.

Figure 3:
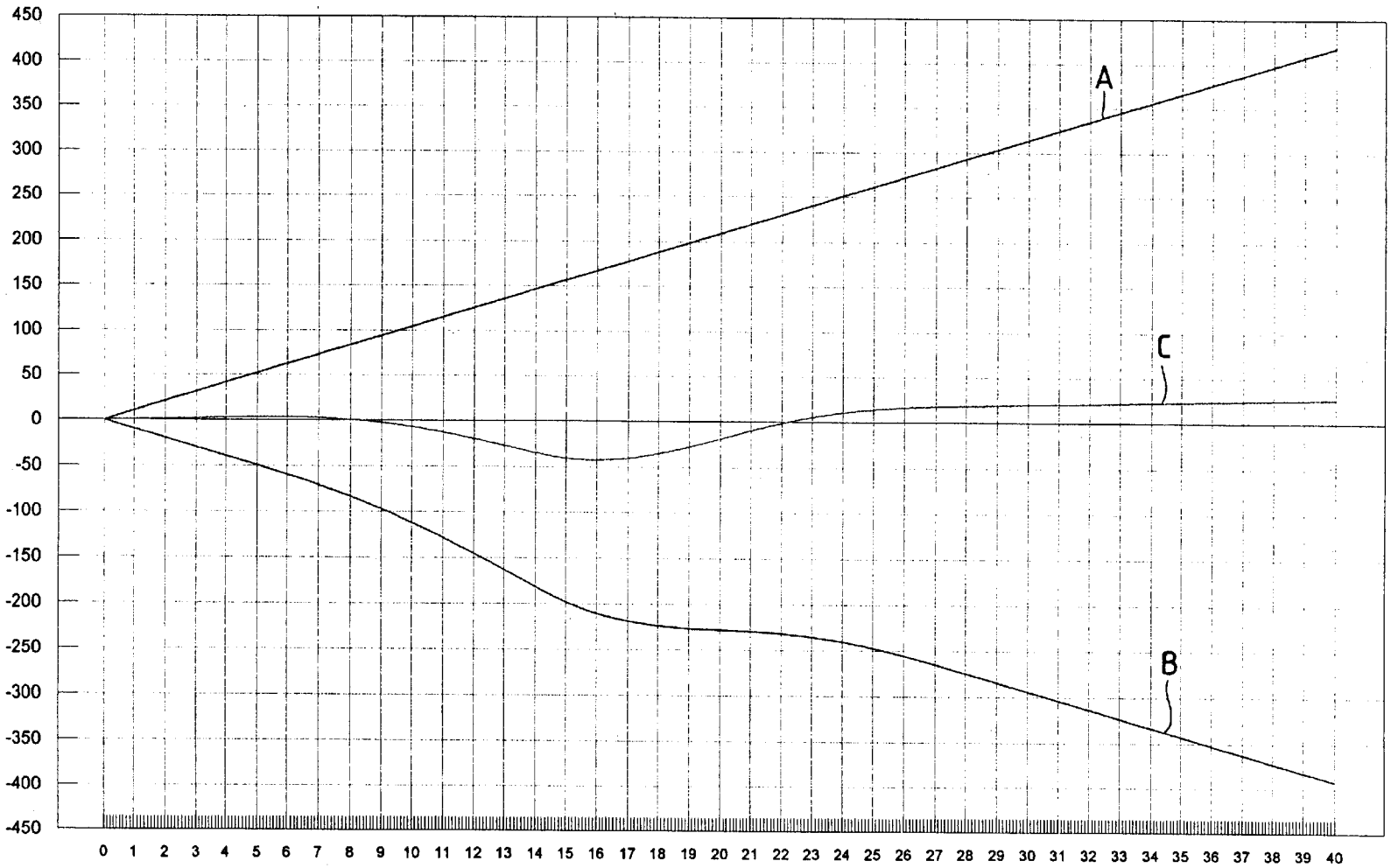
FIG. 3 represents a diagram showing the operating curves of the control unit in FIG. 2.

Going into greater detail in the description of movement, it can be seen that the motor that rotates the shaft 17 of the circular comb 18 is operated with uniform rotary motion, where this motion is indicated in the graph in FIG. 3 with a straight line inclined upwards (straight line A).

Figure 4:
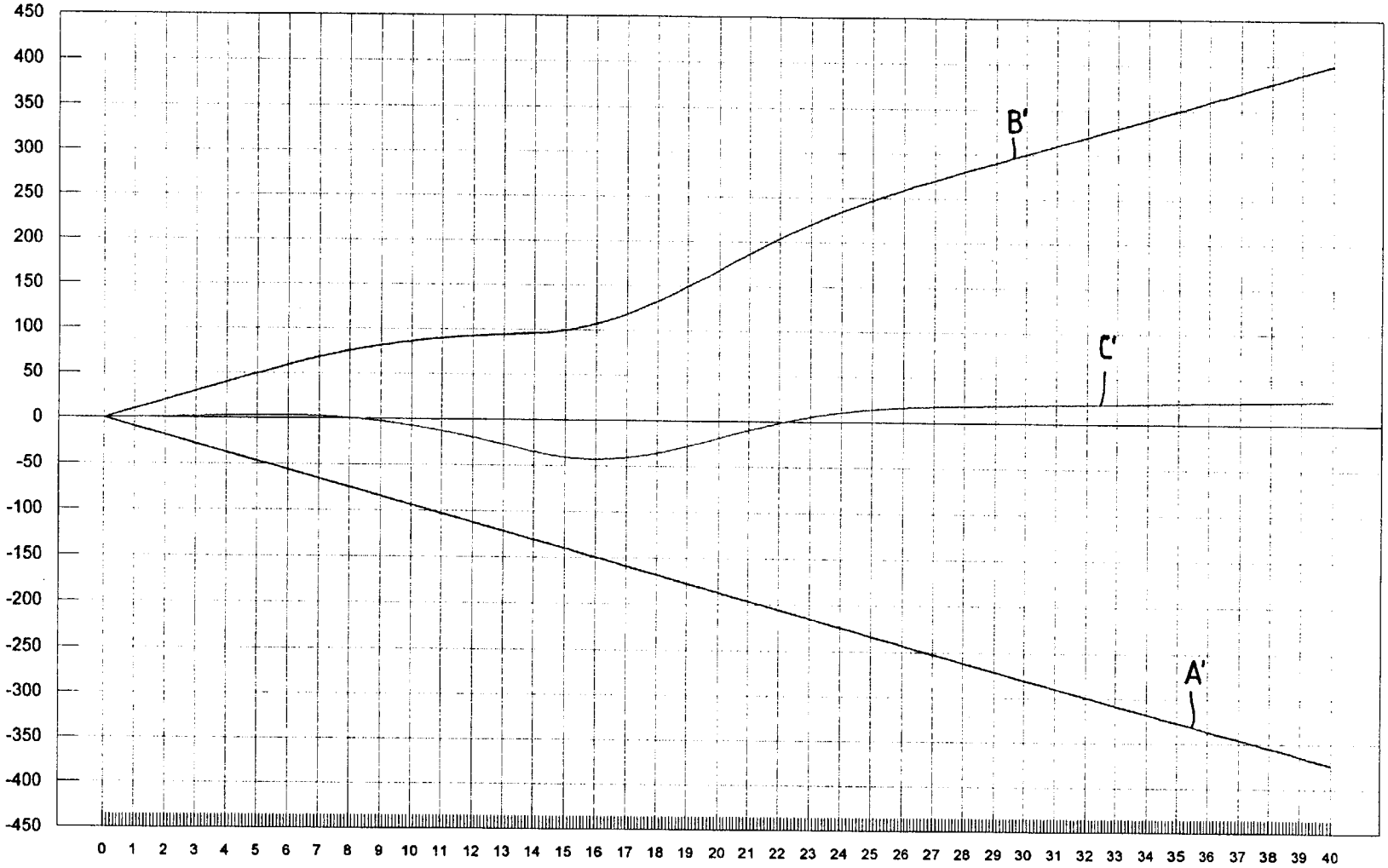
FIG. 4 represents a diagram showing the operating curves of a control unit, according to another embodiment of the present invention.

Incidentally, in the graphs in FIGS. 3–4 it can be seen that the phase index has been indicated on the abscissa; according to a commonly used convention in the technical sector of the invention, this has been divided into 40 parts corresponding to a round angle.

The ordinate indicates the millimetres of forward or backward movement of the various components involved in the control unit of the invention.

The secondary motor 11, is instead operated with a law of motion represented in the lower half of the same graph with the modulated curve B, where in the course of one turn there is slight acceleration followed by slight deceleration in relation to a mean value.

The resulting motion on the detaching cylinders 22 and 23 is given, due to interaction of the components of the control unit 10 described previously, by the algebraic sum of the values of the curves A and B, represented in the curve C.

This motion has the characteristics typical to "pilgrim step" motion, in which a phase of slight backward movement is followed by a forward phase.

It is important to point out that, according to the invention, this motion is obtained by combining the action of two electric motors, each of which operates without having to stop and without having to change the direction of rotation, as both motors mesh at all times.

A second alternative embodiment of the invention envisages that the shaft 17 is always operated with uniform rotary motion, but with different values.

In the case in FIG. 3, rotation A of the shaft 17 connected to the first motor is represented with positive value, while modulated rotation B is represented with a negative value, that is in opposite rotation.

The absolute value of A is prevails over the value of B and therefore their sum C is positive.

In the case in FIG. 4, rotation A' of the shaft 17 connected to the first motor is represented with a negative value, while modulated rotation B' in the opposite direction, that is first accelerated and then decelerated, is represented with a positive value.

In fact, in the graph in FIG. 4, a straight line inclined downwards (straight line A') indicates the uniform rotary motion that operates the shaft 17, the curve B' indicates the law of motion of the motor 11 and the curve C' indicates the law of motion resulting from the algebraic sum of the values of the curves A' and B', which is analogous to the law of motion of the curve C and which represents the motion resulting on the detaching cylinders 22 and 23.

The description gives a clear explanation of the characteristics of the control unit for operation of the detaching cylinders in a combing machine, which is the object of the present invention, and of the advantages.

To better identify these advantages the following considerations are expounded below.

With the device of the present invention it is possible to obtain specific "pilgrim step" motion on the detaching cylinders, with only two electric motors, and without requiring to stop the motors and/or change their direction of rotation.

Moreover, the two motors mesh at all times.

Lastly, it is clear that numerous variation may be made to the control unit for operation of the detaching cylinders in a combing machine, which is the object of the present invention, without departing from the principles of intrinsic novelty of the inventive idea.

In the practical embodiment of the invention, the materials, shapes and dimensions of the details illustrated may vary according to requirements and these may be replaced with others that are technically equivalent.

What is claimed is:

1. A control unit (10) for "pilgrim step" operation of a plurality of detaching cylinders (22,23) in a combing machine, comprising a first electric motor (1), which rotates with uniform motion components (30) of the aforesaid combing machine by way of a shaft (17) and a second electric motor (11), which rotates a shaft (12), said shaft (12) being connected to components to transmit motion to said detaching cylinders (22, 23), said first electric motor (1) also acting on components of a control unit (10) to transmit motion to said detaching cylinders (22, 23), and said second motor (11) being provided with means of operation having a unidirectional mode of operation comprising acceleration and deceleration phases, where both said first and second motors are connected by tooth gears (15, 16) at all times and always rotate continuously in the same direction and their rotary motions are combined by means of a differential device to obtain resulting motion of the "pilgrim step" type on said detaching cylinders (22, 23).

2. A control unit (10), as claimed in claim 1, characterized in that said differential device composes a planetary gear (13), provided with at least one planet wheel (14) fitted idle on an input disk (20), where said planetary gear (13) is fitted idle on said shaft (12) connected to said second motor.

3. A control unit (10), as claimed in claim 2, characterized in that said planetary gear (13) has a toothed wheel (15) engaged by a corresponding toothed wheel (16), rotated by said first motor (1) controlling operation of the circular comb (18) of said combing machine.

4. A control unit (10), as claimed in claim 3, characterized in that said planet wheel (14), fitted on the planetary gear (13) on said input disk (20), is idle and rotated by the rotation of said shaft (12), by means of engagement with a pinion (12'), and it is connected, by means of an output disk (20') to another planet wheel (14') to transmit its motion to said detaching cylinders (22, 23).

5. A control unit (10), as claimed in claim 4, characterized in that said planet wheel (14') transmits its motion, by means of a toothed pinion (12"), to a transmission component (21), which is idle and is connected by means of its toothed wheel to said detaching cylinders (23, 24).

* * * * *